US007263755B2

(12) United States Patent
Lange

(10) Patent No.: US 7,263,755 B2
(45) Date of Patent: Sep. 4, 2007

(54) METHOD FOR THE MANUFACTURE OF FILLINGS FOR UTILIZATION IN THE MECHANICAL PROCESSING OF AQUEOUS PAPER FIBER STOCK

(75) Inventor: Werner Lange, Auernheim (DE)

(73) Assignee: Voith Patent GmbH, Heidenheim (DE)

( * ) Notice: Subject to any disclaimer, the term of this patent is extended or adjusted under 35 U.S.C. 154(b) by 267 days.

(21) Appl. No.: 10/701,930

(22) Filed: Nov. 5, 2003

(65) Prior Publication Data

US 2004/0128817 A1 Jul. 8, 2004

(30) Foreign Application Priority Data

Dec. 13, 2002 (DE) ..... 102 58 324

(51) Int. Cl.
*B23P 11/00* (2006.01)
*B02C 7/12* (2006.01)

(52) U.S. Cl. ..... 29/428; 29/464; 29/469; 29/557; 241/298

(58) Field of Classification Search ..... 29/428, 29/464, 469, 557, 423; 241/261.2, 261.3, 241/296, 297, 298
See application file for complete search history.

(56) References Cited

U.S. PATENT DOCUMENTS 3,028,634 A * 4/1962 Coghill ..... 19/66.1
3,545,513 A 12/1970 Palyl ..... 146/182
3,614,826 A 10/1971 Pilao ..... 29/434
3,745,645 A 7/1973 Kurth et al. ..... 29/530
4,116,392 A 9/1978 Zinezi ..... 241/296
4,157,669 A * 6/1979 Pilao ..... 76/115
4,428,538 A 1/1984 Valdivia ..... 241/298
4,535,536 A * 8/1985 Wyss ..... 29/845
4,620,675 A * 11/1986 Kirchner ..... 241/261.3
4,625,926 A * 12/1986 Kirchner ..... 241/261.2
4,681,270 A 7/1987 Oberhofer ..... 241/298
5,467,931 A * 11/1995 Dodd ..... 241/261.2
5,476,228 A * 12/1995 Underberg ..... 241/296
5,727,743 A 3/1998 Schneid et al. ..... 241/261
5,740,972 A * 4/1998 Matthew ..... 241/298
5,779,168 A * 7/1998 Meltzer ..... 241/261.1
5,836,525 A * 11/1998 Garnier et al. ..... 241/28
5,893,525 A * 4/1999 Gingras ..... 241/298
5,921,486 A * 7/1999 Matthew ..... 241/298
5,954,283 A 9/1999 Matthew ..... 241/298
6,092,286 A * 7/2000 Lange ..... 29/896.62
6,363,601 B1 * 4/2002 Schneid ..... 29/436

(Continued)

FOREIGN PATENT DOCUMENTS

DE 195 23 704 1/1997

(Continued)

*Primary Examiner*—Essama Omgba
(74) *Attorney, Agent, or Firm*—Taylor & Aust, P.C.

(57) ABSTRACT

A method for fabricating fillings that are utilized in refiners for the purpose of refining paper fiber stock. The filling manufactured in accordance with the method of the present invention includes a base body, an overlay template on the base body and processing elements. The processing elements are inserted into the overlay template that is equipped with corresponding openings. A solid connection is subsequently produced, for example, by way of high temperature welding. Advantages of the method include the selection of optimum materials for the processing elements; the fabrication process is flexible; and the method is especially economical, when measured by the quality of the produced fillings.

19 Claims, 3 Drawing Sheets

U.S. PATENT DOCUMENTS

| | | | | |
|---|---|---|---|---|
| 6,422,496 | B1 * | 7/2002 | Doelle | 241/261.2 |
| 6,427,903 | B1 * | 8/2002 | Foulke et al. | 228/246 |
| 6,607,153 | B1 * | 8/2003 | Gingras | 241/261.3 |
| 6,935,589 | B1 * | 8/2005 | Matthew | 241/298 |
| 2004/0144834 | A1 * | 7/2004 | Nomoto et al. | 228/180.1 |
| 2005/0161542 | A1 * | 7/2005 | Theut | 241/298 |

FOREIGN PATENT DOCUMENTS

| | | | |
|---|---|---|---|
| DE | 196 03 548 | | 5/1997 |
| EP | 1439744 | A2 * | 7/2004 |
| WO | WO82 /04375 | * | 12/1982 |
| WO | 99/37402 | | 7/1999 |

* cited by examiner

METHOD FOR THE MANUFACTURE OF FILLINGS FOR UTILIZATION IN THE MECHANICAL PROCESSING OF AQUEOUS PAPER FIBER STOCK

BACKGROUND OF THE INVENTION

1. Field of the Invention

The current invention relates to a method for the manufacture of fillings, and, more particularly, to a method for the manufacture of fillings for use in the mechanical processing of aqueous paper fiber stock.

2. Description of the Related Art

Fillings serve to disperse contaminants in the fiber stock, or deflaking in the refining of paper fibers, in other words they aid in the slushing of paper fiber agglomerates. They are then utilized in refiners, deflakers or dispergers. Machines are equipped with at least one rotor and at least one stator, having either discoid or conical surfaces on which the fillings are mounted, so that spaces can form between them. Many fillings have bars and channels on their working surfaces. This is the reason that they are frequently referred to as "knife type fillings". Other fillings, for example, when used as inserts in dispergers are in the form of toothed rings. Disperger fillings are illustrated and described in DE 195 23 704 A1. It is known that, in addition to the shape of the bars, channels and teeth, the material from which they are manufactured also affects the processing of the fiber stock.

During the mechanical processing, that utilizes this type of filling, the paper fibers are present in the form of slush, with a solids content of approximately 2-8%, or as a viscous substance having a higher solids content. As a rule, dispergers operate at a solids content of between 15% and 25%.

The fillings are subject to wear and tear and must therefore be replaced at certain intervals. However, wear and tear may prematurely result in changes of the process operation. Shape, specifically an edge shape, and assembly surfaces have an overwhelming influence on the process. These changes present the disadvantage that, from a certain point in time forward, optimum results can no longer be achieved on the same machine.

It is therefore understandable that considerable expenditure is dedicated to the development of fillings, particularly to the design of their shape and to the selection of the material. It has been demonstrated that materials that are particularly suitable for the processing elements possess characteristics that may be very problematic if utilized for the base body of the assembly. This is particularly true of materials that are very hard and brittle, which do not possess the toughness that is necessary for the base body. In addition, such materials are relatively expensive and costly to produce, and in comparison with conventional metallic materials, can only be machined at great expense.

The base body of a processing tool represents the connection between the processing elements and the remaining components, such as those of a refiner. High stability requirements are imposed upon the base body, due to the high forces that occur in a refiner. It must also be feasible to mount the base body securely to the refiner, utilizing, for example, high torque rated screws. The base body is made of an especially strong and ductile material because of this requirement.

A method for the fabrication of fillings is already known from DE 196 03 548 A1, whereby they are assembled from components that are manufactured separately. According to this publication a high temperature soldering process conducted under a vacuum is utilized. Even though these methods are basically suitable, they are expensive in their execution and do not always result in sufficient stability.

A method for the production of refiner fillings is described in WO 99/37402 A 1, whereby it is also possible to select a different material for the blades as opposed to the base plate. However, this method is very expensive and complicated due to the multitude of individual components that have to be precisely assembled.

What is needed in the art is a method for the manufacture of the fillings so that their fabrication is substantially simplified and such that suitably hard materials, for highly stressed processing elements, can be used.

SUMMARY OF THE INVENTION

An overlay template is utilized by the present method consisting of a plate of uniform thickness, into which openings are cut by a laser cutter. The present method is adaptable such that it is easily feasible to manufacture different openings for fillings that produce different refining actions. The contour of the overlay template can be slightly smaller than that of the associated base body. The overlay template can be easily assembled with the base body prior to installing the processing elements, for example, by the welding of joints. Since the processing elements are initially manufactured separately, it is possible to utilize optimum materials and to produce the shape of the fillings relatively simply. The overlay template offers the opportunity to position the processing elements precisely and securely at the correct location on the base body and to fasten them there in a subsequent procedure. Since generally a larger number of processing elements are required for one filling it would make sense to insert the element into the overlay template by way of an automatic device. The method not only has the advantage of being quickly implemented and easily automated, but also offers superior strength since the processing elements can be joined with the base body, as well as with the overlay template. A high temperature welding process is particularly suitable for this, with which all welds associated with one processing unit can be produced at the same time. Such procedures are normally carried out at very high temperature, i.e. above 1000° C., preferably approximately 1050° C. It is an advantage to use a controlled atmosphere, i.e. argon; a vacuum is also feasible.

In another embodiment of the present invention, not only are the processing elements and the overlay template welded together, but during the same procedure also the overlay template and the base body are welded leading to an even higher rigidity of the entire assembly.

Advantageously, the expensive machining of hard structures on the processing elements is reduced or eliminated, since the precision of the fillings manufactured in this manner is higher than those manufactured using conventional methods and material such as, cast units.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
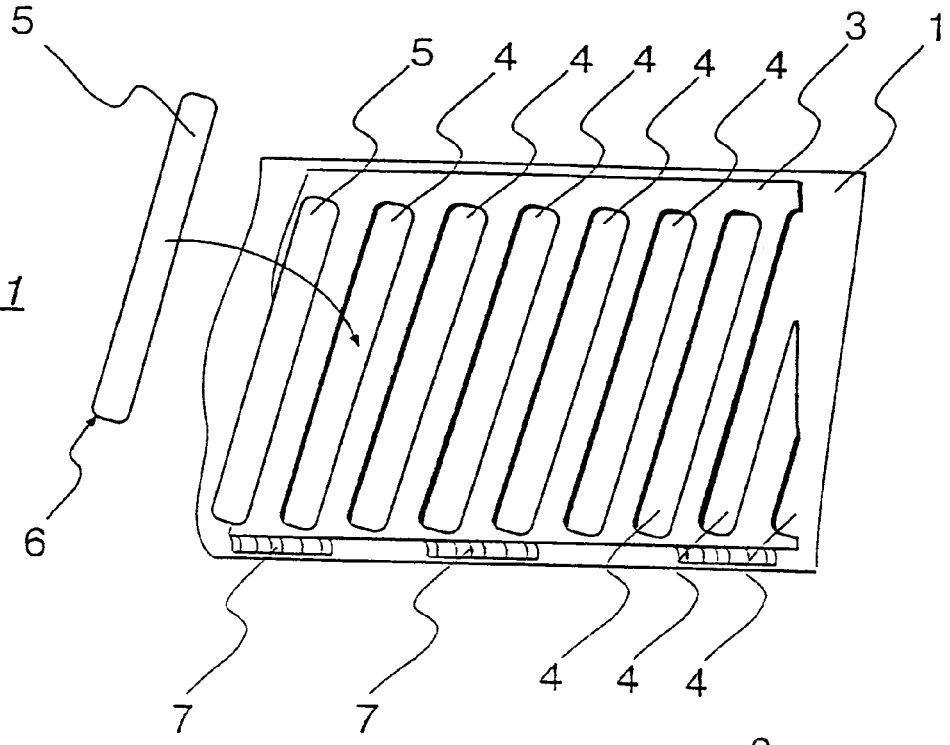
FIG. 1 is a view of a section of a filling during the manufacturing process, according to one embodiment of the present invention.
Figure 8:
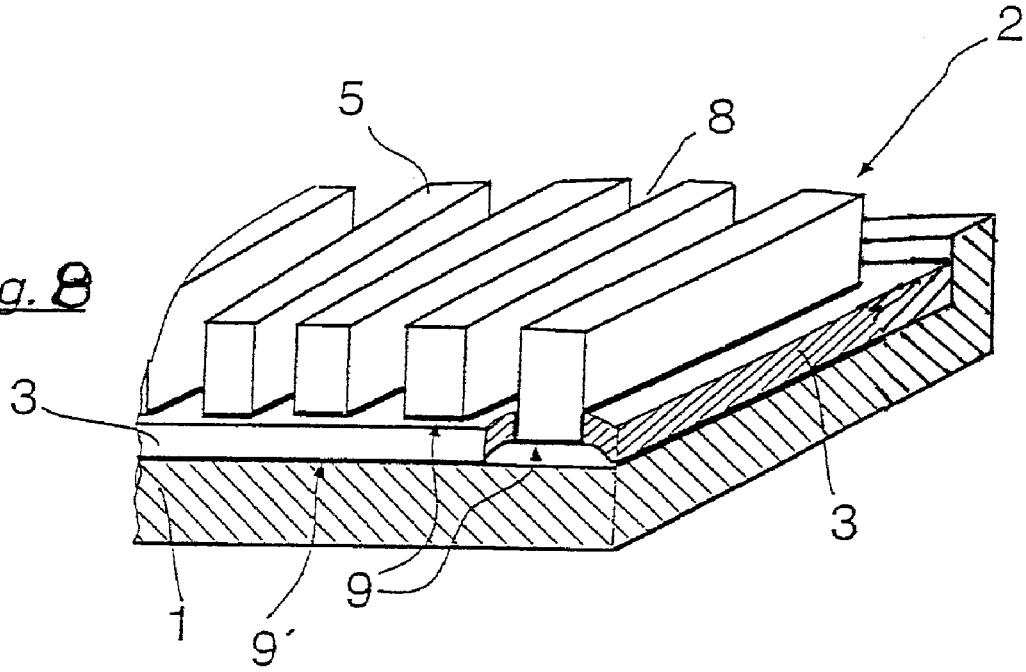
FIG. 8 is a perspective view of a section of a filling after the manufacturing process according to another embodiment of the present invention.

Referring now to the drawings, and more particularly to FIG. 1, there is illustrated a section of a base body 1 that is overlaid with an overlay template 3, whereby the connection is produced by welding seams 7. Overlay template 3 is equipped with a significant number of through-openings 4. A processing element 5 is inserted in each opening 4. Processing elements 5 are strip-shaped and can, for example, be manufactured from rolled profiles. The height of the surface is constant and corresponds with that of base 6. Openings 4 and the shape of base 6 are matched so that processing element 5 can be inserted into opening 4 without play. In the typical instances, where a high temperature welding procedure is utilized, the solder can already be applied to the relevant surface prior to inserting. In this embodiment it is advantageous to create solder deposits in the form of small indentations or grooves in the components that are to be connected (not shown in FIG. 1). Overlay template 3 can also be recessed, in other words embedded, in an appropriately formed base body, as illustrated in FIG. 8, which shows elements 5 placed into base body 1 wherein overlay template and base body 1 are embedded together thereby forming overlay template 3 as part of base body 1.

Figure 2:
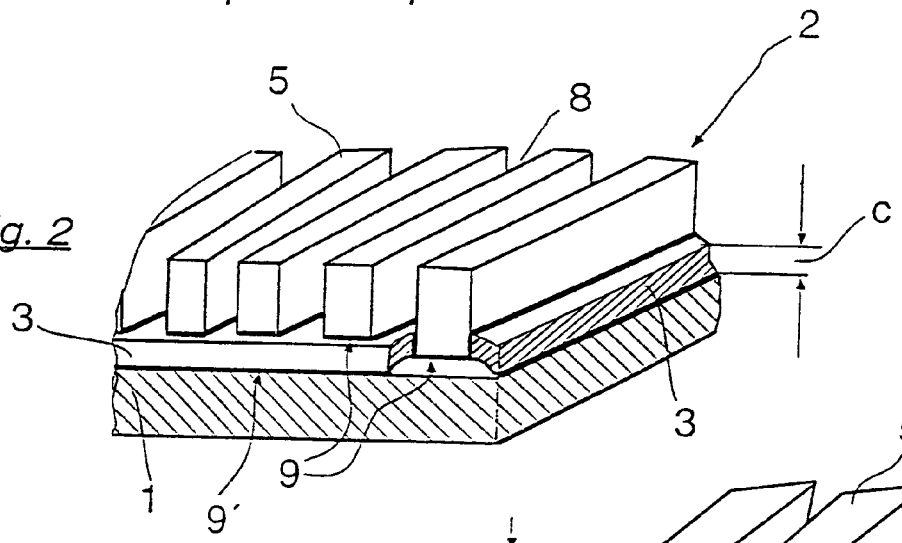
FIG. 2 is a perspective view of a section of a filling after the manufacturing process, according to the present invention.
Figure 4:
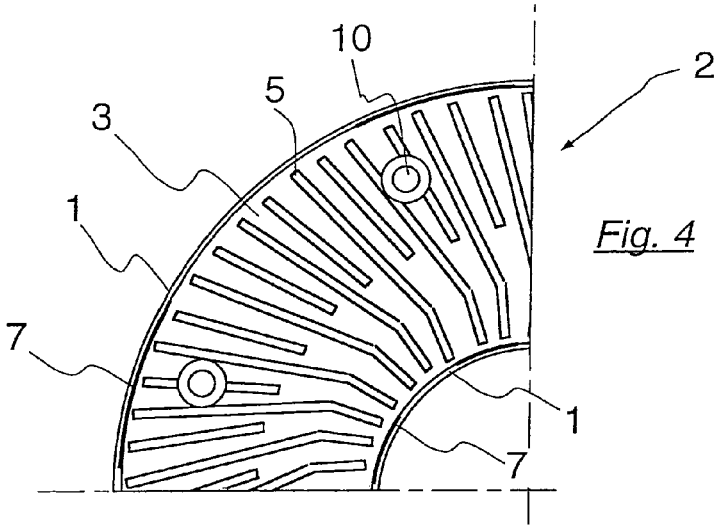
FIG. 4 is a view of a 90° segment of a filling of the present invention for disc refiners.

Now additionally referring to FIG. 2, there is illustrated a perspective partial view of finished filling 2, showing that soldered surface 9 (depicted as a thicker line) connects processing elements 5 with base body 1, as well as with overlay template 3. This large surface connection is a particular advantage since the load on the filling, during operation, can be relatively high. In this example, welded surface 9' extends across the contact surfaces between overlay template 3 and base body 1. This is however not necessary in all instances and may increase the manufacturing expense. The thickness c of overlay template 3 is generally between 2 and 10 mm. Filling 2, that is partially illustrated in FIG. 2, may, for example, be understood to be a refiner segment (see FIG. 4) for a disc refiner that includes a multitude of strip shaped elements 5. Such fillings are also known as knife fillings. They are equipped with screw holes 10 and are screwed onto the rotor or the stator of a disc refiner. These are known to be wear and tear items that have to be replaced at certain intervals.

Figure 3:
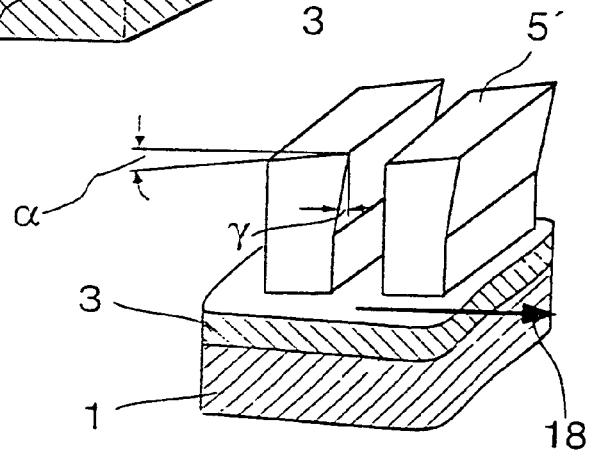
FIG. 3 illustrates a special shape of the processing elements of the present invention.

Now, additionally referring to FIG. 3, there is illustrated another embodiment of the present invention in the form of a different shape of processing elements 5', which is simplified by the method of the present invention. The front cutting edge on the rotor, when viewed in moving direction 10, has on its upper side, opposite the plane parallel to moving direction 18, an angle $\alpha$ of between 0° and 10° is shown, and on the front side, opposite the vertical plane, an angle $\gamma$ of between 0° and 10° is illustrated. This prevents undesirable edge chamfering.

Figure 5:
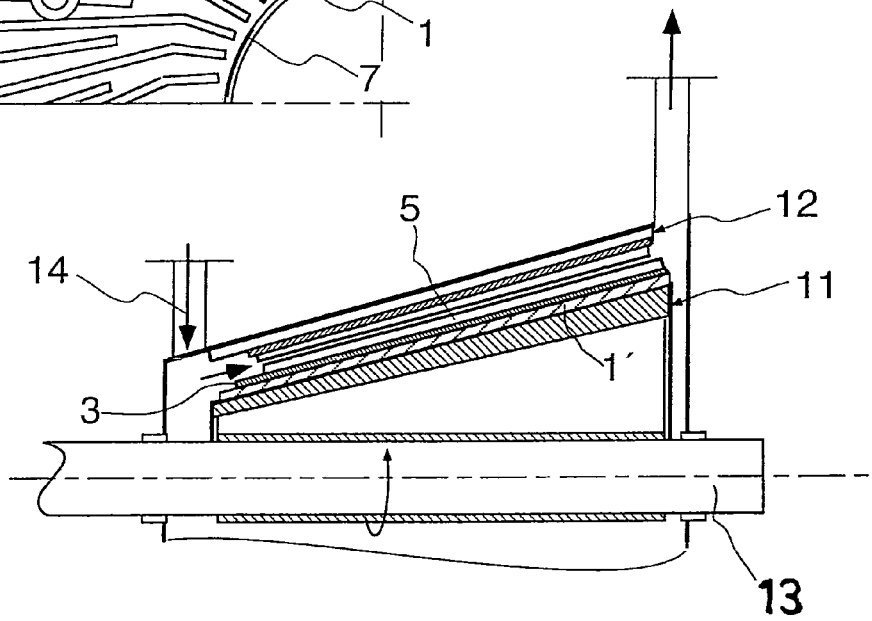
FIG. 5 is a cross-sectional view of a section of a conical refiner that is equipped with a filling of the present invention.

Now, additionally referring to FIG. 5, there is shown a conical refiner. The method of the present invention may be used when a filling for a conical refiner needs to be manufactured. In that instance the base body 1' has the shape of a truncated cone, or a section thereof. This too, is equipped with overlay template 3 into which processing elements 5 are inserted and fixed in the manner already previously described. In FIG. 5 it can also be seen that the fillings, that were produced under the described method, can be part of rotor 11, as well as stator 12. In most refiners both the rotor and the stator are generally equipped with knife assemblies. A suspension 14, that is to be refined, is run between the knifes through the machine. Rotor 11 is driven by shaft 13.

Figure 6:
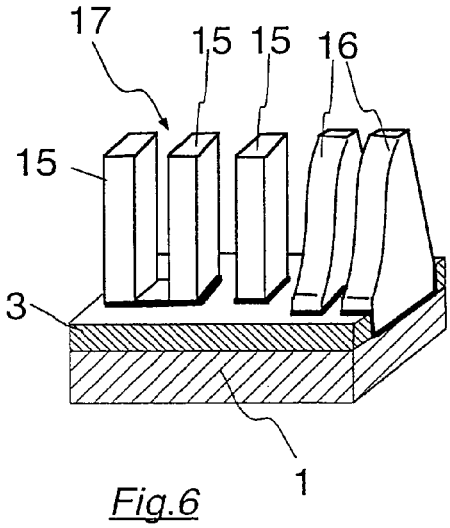
FIG. 6 illustrates a section of a disperger or deflaker assembly that was manufactured according to the method of the present invention.
Figure 7:
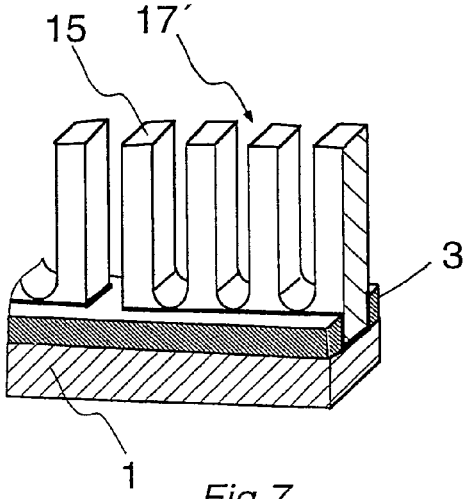
FIG. 7 illustrates a variation of the assembly shown in FIG. 6.

There are also applications, in the areas of disperging and deflaking of paper fiber stock, whereby assemblies are utilized, which have high performance tooth shaped processing elements. The method according to the present invention can also be utilized. FIGS. 6 and 7 each show a base body 1 with an overlaid template 3 and a number of already inserted processing elements 15, 16 and 17. Examples of several different tooth shapes are illustrated, i.e. cubical teeth 15, or beveled teeth 16 that, according to the present invention, serve as processing elements. Additionally, a larger number of shaped, easily manufactured individual teeth 16 can be used. Also, several teeth can be combined in larger or smaller groups of teeth, 17 and 17', and then be inserted into overlay template 3. The fabrication of such an assembly is similar to that already described, in that the feet of processing elements 17' and the openings in overlay template 3, have approximately the same shape so that processing elements 17' can be inserted. Subsequently, final securing of the processing elements to overlay template 3 and base body 1 occurs. Hardened brittle metal alloys, that have been optimized for fiber processing, can be utilized as materials for the processing elements. They may also be hardened following the high temperature welding process, or during it. For example, cooling after high temperature welding can be done so rapidly that, when using carbon steels, the processing elements are thermally hardened in the process.

Base body 1 may consist of relatively ductile Cr—Ni steel. Since it is shielded from the fiber suspension by overlay template 3 and processing elements 5 it can also be fabricated from steel that is not corrosion proof, thereby further reducing costs. Another option is to coat base body 1 with a corrosion proof material.

Advantageously, overlay template 3 can be fabricated from relatively ductile Cr—Ni steel plate into which openings 4 are cut by a laser cutter.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the manufacture of fillings for the refining of aqueous paper fiber stock, comprising the steps of:

providing at least one base body;

manufacturing a plurality of processing elements;

fabricating an overlay template apart from said at least one base body, said overlay template having a plurality of openings extending therethrough, each of said plurality of openings being shaped to correspond to at least one of said plurality of processing elements;

connecting said overlay template to said at least one base body;

inserting a corresponding one of said plurality of processing elements into each of said plurality of openings; and joining said plurality of processing elements to said overlay template, thereby forming a plurality of solid joints therebetween, said joining step including the sub-step of high temperature welding of said plurality of processing elements to form said solid joints.

2. The method of claim 1, wherein said high temperature welding step is done at a temperature of at least 1,000° C.

3. The method of claim 1, wherein said high temperature welding step is carried out under one of a vacuum and a controlled atmosphere.

4. The method of claim 1, further comprising the step of cooling said plurality of processing elements after said high temperature welding step, thereby hardening said processing elements.

5. The method of claim 1, further comprising the step of surface treating said plurality of processing elements one of during said high temperature welding step and after said high temperature welding step.

6. The method of claim 5, wherein said surface treating step improves at least one of hardness, wear resistance and tear resistance of said processing elements.

7. The method of claim 5, wherein said high temperature welding step and said surface treating step are carried out in the same oven.

8. The method of claim 1, wherein said plurality of processing elements and said base body are made from different materials.

9. The method of claim 1, wherein said overlay template and said base body are made from materials whose thermal expansion coefficients are within 10% of each other.

10. The method of claim 1, wherein said fabricating step includes a sub-step of cutting said openings in a plate using a laser.

11. The method of claim 10, wherein said plate has a contour that substantially corresponds with a contour of at least one said base body.

12. The method of claim 1, wherein said overlay template is fabricated from a Cr—Ni steel alloy.

13. The method of claim 1, wherein each of said plurality of processing elements is a strip-shaped protrusion having a plurality of protrusions extending outward from said base body, said protrusions having grooves therebetween.

14. The method of claim 13, wherein each of said strip-shaped protrusions extend above said overlay template more than 2 mm and less than 20 mm.

15. The method of claim 13, wherein each of said strip-shaped protrusions have a width of more than 2 mm and less than 30 mm.

16. The method of claim 15, wherein said width is more than 2 mm and less than 10 mm.

17. The method of claim 1, wherein said plurality of processing elements are teeth positioned substantially normal to said base body.

18. A method for the manufacture of fillings for the refining of aqueous paper fiber stock, comprising the steps of:

providing at least one base body;

manufacturing a plurality of processing elements;

fabricating an overlay template apart from said at least one base body, said overlay template having a plurality of openings extending therethrough, each of said plurality of openings being shaped to correspond to at least one of said plurality of processing elements;

connecting said overlay template to said at least one base body;

inserting a corresponding one of said plurality of processing elements into each of said plurality of openings; and joining said plurality of processing elements to said overlay template, thereby forming a plurality of solid joints therebetween, said joining step additionally including a substantially simultaneous joining of said plurality of processing elements, said overlay template and said base body at their respective contacting surfaces.

19. A method for the manufacture of fillings for the refining of aqueous paper fiber stock, comprising the steps of:

providing at least one base body;

manufacturing a plurality of processing elements;

fabricating an overlay template with a plurality of openings extending therethrough, each of said plurality of openings being shaped to correspond to at least one of said plurality of processing elements, said fabricating step including a sub-step of cutting said openings using a laser;

connecting said overlay template to at least one said base body;

inserting a corresponding one of said plurality of processing elements into each of said plurality of openings; and joining said plurality of processing elements to said overlay template, thereby forming a plurality of solid joints therebetween, said overlay template being embedded into said base body.

* * * * *